US006539182B2

(12) United States Patent
Friedrich

(10) Patent No.: US 6,539,182 B2
(45) Date of Patent: Mar. 25, 2003

(54) IMAGE-FORMING MACHINE HAVING A CONTROL DEVICE FOR DETECTING TONER CLOGGING IN A REPLENISHER STATION

(75) Inventor: Kenneth P. Friedrich, Honeoye, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/820,254

(22) Filed: Mar. 28, 2001

(65) Prior Publication Data

US 2002/0141768 A1 Oct. 3, 2002

(51) Int. Cl.[7] ..... G03G 15/08
(52) U.S. Cl. ..... 399/27; 399/258
(58) Field of Search ..... 399/24, 27, 31, 399/258, 260, 43, 9; 222/DIG. 1; 430/120

(56) References Cited

U.S. PATENT DOCUMENTS 5,216,462 A * 6/1993 Nakajima et al. ..... 399/27
5,287,151 A * 2/1994 Sugiyama ..... 399/258
5,634,169 A 5/1997 Barru et al.
5,754,916 A * 5/1998 Kitayama et al. ..... 399/27
6,100,601 A * 8/2000 Baker et al. ..... 399/27 X

FOREIGN PATENT DOCUMENTS

JP 05-088551 * 4/1993

OTHER PUBLICATIONS

Peak Performance, Peak–Detecting Differential Hall–Effect and Magnet Subassembly; Allegro MicroSystems, Inc.; Dec. 2, 1998.

* cited by examiner

*Primary Examiner*—Sophia S. Chen

(57) ABSTRACT

The present invention provides an image-forming machine having a photoconductor forming a surface and a toning station adjacent the surface. The toning station has at least one roller for supplying toner near the surface. Additionally, the image-forming machine has a replenisher station for supplying toner to the toning station. The replenisher station includes a moving part connected with the replenisher station, and a control device located near the moving part. The control device monitors the movement of the moving part and generates a timing signal in response. The present invention also provides a method for detecting toner clogging in a replenisher station for an image-forming machine. The method includes monitoring the movement of a moving part connected with the replenisher station, generating a timing signal in response to the movement of the moving part, and determining whether toner is clogged in the replenisher station based upon the timing signal.

30 Claims, 6 Drawing Sheets

IMAGE-FORMING MACHINE HAVING A CONTROL DEVICE FOR DETECTING TONER CLOGGING IN A REPLENISHER STATION

FIELD OF THE INVENTION

This invention relates generally to image-forming machines and methods having replenisher stations. More particularly, this invention relates to electrophotographic image-forming machines and methods having replenisher stations with moving parts that can be clogged by toner.

BACKGROUND OF THE INVENTION

Electrophotographic (EP) image-forming machines are used to transfer images onto paper or other medium. Generally, a photoconductor is selectively charged and optically exposed to form an electrostatic latent image on the surface. Toner is deposited onto the photoconductor surface. The toner is charged, thus adhering to the photoconductor surface in areas corresponding to the electrostatic latent image. The toner image is transferred to the paper or other medium. The paper is heated for the toner to fuse to the paper. The photoconductor is then refreshed—cleaned to remove any residual toner particles—to make it ready for another image.

EP image-forming machines typically include a toning station adjacent the surface of the photo conductor. The toning station typically has a series of rollers to move the toner towards photo conductor surface and deposit the toner onto the photo conductor surface. The toning station also helps charge the toner, thus allowing toner to adhere to the photoconductor surface in areas corresponding to the electrostatic latent image.

EP image-forming machines also typically include a replenisher station for supplying toner to the toning station. In general, replenisher stations include a replenisher housing which forms a cavity adapted to receive toner from a toner bottle. The toner bottle houses a fresh supply of toner to be fed into the image-forming machine, and in particular, to be fed into the replenisher station. Upon attaching and mounting the toner bottle onto the replenisher housing, the toner within the toner bottle falls into the cavity. Once the toner is in the cavity, the toner is then guided to the toning station. In some EP image-forming machines, the replenisher station includes a fluted roller that turns and meters the toner, and then guides the toner into the toning station. In other EP image-forming machines, the replenisher station includes a brush, or a series of rotatable brushes that turn and meter the toner, and then guide the toner into the toning station.

In even other EP image-forming machines, the toner is guided to the toning station through a shaft connected with the cavity at a first opening and connected with the toning station at a second opening. An auger is mounted within the shaft in order to help move the toner from the cavity to the toning station. As the auger rotates, the toner is metered and guided from the cavity of the replenisher station to the toner station.

In some EP image-forming machines, the replenisher station includes a replenisher agitator located within the cavity. The replenisher agitator is typically moveably connected to the replenisher housing and is designed to break up toner agglomerates, meter the toner, and then guide the toner to the toning station.

Often times, when the toner is being metered and then guided to the toning station from the replenisher station, the toner will clog moving parts within the replenisher station, such as, the fluted roller, the brushes, the auger, or the replenisher agitator, disabling their capability to help guide and meter the toner. If the moving parts are clogged with toner, less toner can be supplied to the toning station. As a result, when less toner is supplied to the toning station, the EP image-forming machine becomes prone to producing images that have image artifacts and are of poor quality. In addition, the user is prompted to change the toner bottle prematurely, causing the toner to spill from the bottle. If the toner has clogged moving parts within the replenisher station, the user of the EP imaging-forming machine should be immediately alerted of this so that the clogging can be remedied.

Accordingly, there is a need for an electrophotographic image-forming machine that detects toner clogging within a replenisher station, and in particular within the moving parts of the replenisher station, and signals a user.

BRIEF SUMMARY OF THE INVENTION

According to a first aspect of the present invention, an image-forming machine is provided. The image-forming machine has a photoconductor having a surface. The image-forming machine also has a toning station adjacent the surface of the photoconductor. The toning station has at least one roller for supplying toner near the surface of the photoconductor. Additionally, the image forming machine has a replenisher station for supplying toner to the toning station. The replenisher station includes a moving part connected with the replenisher station, and a control device located near the moving part, wherein the control device monitors the movement of the moving part and generates a timing signal in response.

According to another aspect of the present invention, an image-forming machine is provided. The image-forming machine has a replenisher station for supplying toner to a toning station of the image-forming machine. The replenisher station includes a replenisher housing and a moving part. The replenisher housing forming a cavity adapted to receive toner from a toner bottle, while the moving part is connected with the replenisher housing. The image-forming machine also includes a motor connected with the moving part, and a control device mounted near the moving part. The control device monitors the movement of the moving part and generates a timing signal in response.

According to yet another aspect of the present invention, a replenisher station is provided. The replenisher station is used to supply toner to a toning station of an image-forming machine. The replenisher station has a replenisher housing, a moving part, and a control device. The replenisher housing forms a cavity adapted to receive toner from a toner bottle, while the moving part is connected with the replenisher housing. The control device is located near the moving part, monitors the movement of the moving part, and generates a timing signal in response.

According to another aspect of the present invention, a method for detecting toner clogging in a replenisher station for an image-forming machine is provided. The method includes monitoring the movement of a moving part connected with the replenisher station, generating a timing signal in response to the movement of the moving part, and determining whether toner is clogged in the replenisher station based upon the timing signal.

The following drawings and descriptions set forth additional advantages and benefits of the invention. More advantages and benefits are obvious of the description and may be learned by practice of the invention.

Figure 1:
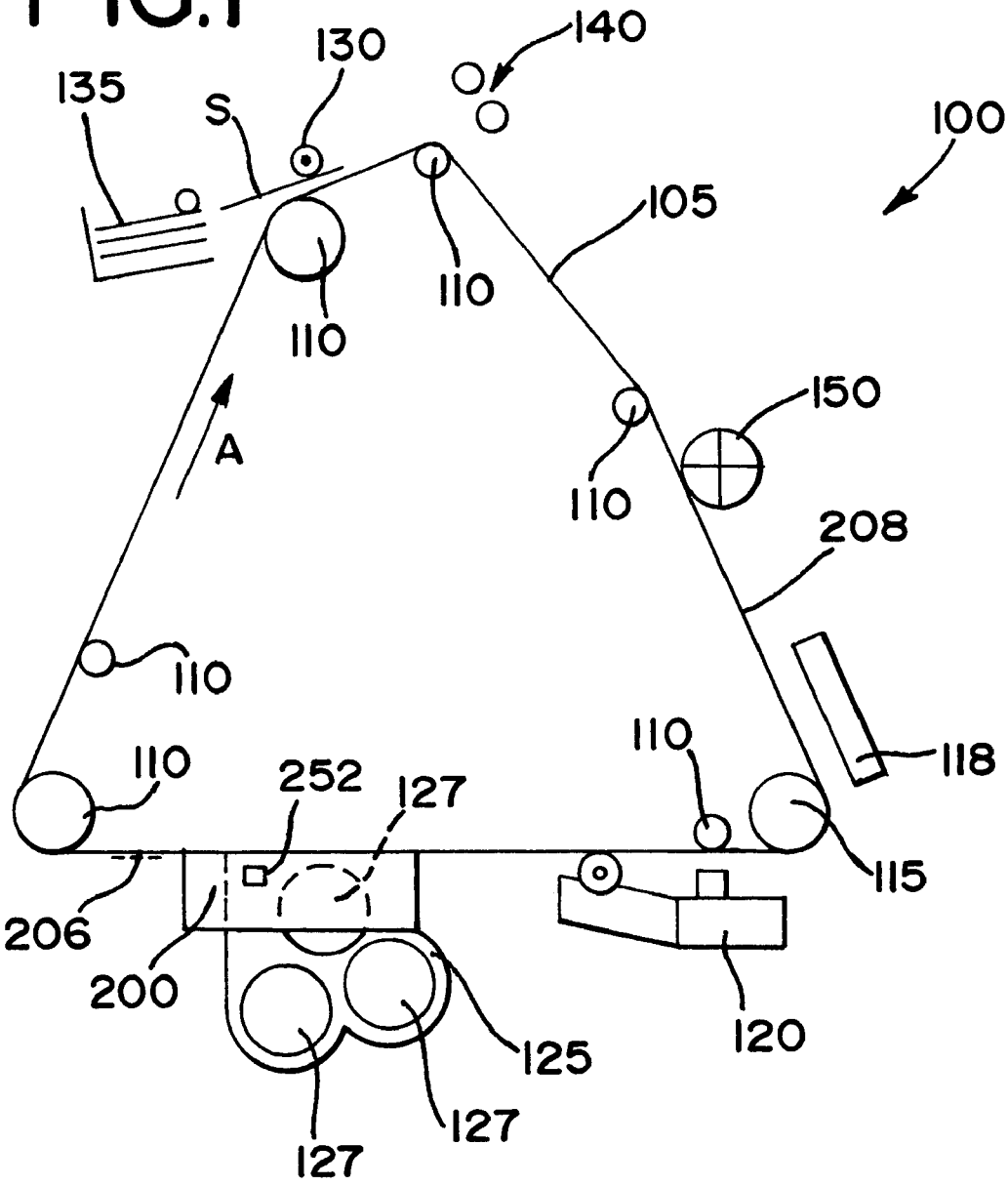
FIG. 1 shows a block diagram of an electrophotographic image-forming machine having a control device in a replenisher station for generating a timing signal, according to one embodiment of the present invention.

For simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DETAILED DESCRIPTION OF THE INVENTION

FIG. 1 shows a block diagram of an electrophotographic (EP) image-forming machine 100 having a control device 252 and a replenisher station 200 for generating a timing signal according to an embodiment of the present invention. A photo conductor 105 is operatively mounted on support rollers 110. A drive roller 115 moves the photo conductor 105 in the direction indicated by arrow A. A primary charger 118, an exposure machine 120, a toning station 125, a transfer roller 130, a fusing station 140, and a cleaner 150 are operatively disposed about the photo conductor 105. Photo conductor 105 has a photosensitive or active surface 208 upon which toner 206 is deposited onto. The toning station 125 is adjacent the active surface 208 of photo conductor 105 and has at least one roller 127 for supplying toner 206 near the active surface 208 of the photo conductor 105. While not shown, the EP image-forming machine 100 has a separation charger (which may be incorporated with the transfer charger 130), a microprocessor control, and other features. Sheets S are supplied from a sheet supply 135.

Figure 2:
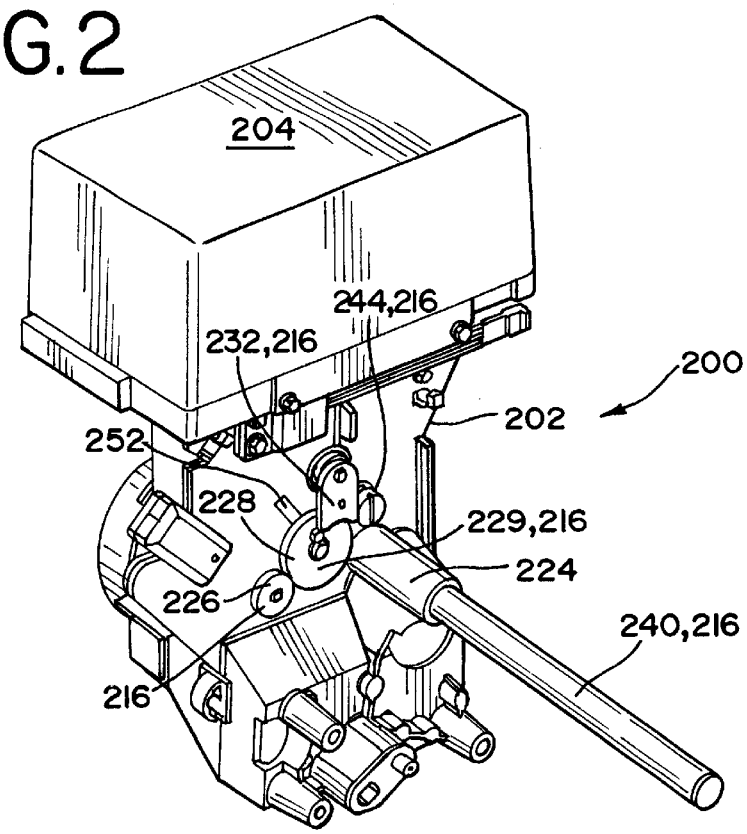
FIG. 2 shows a perspective view of a replenisher station having a control device for generating a timing signal with a toner bottle attached, according to one embodiment of the present invention.
Figure 2A:
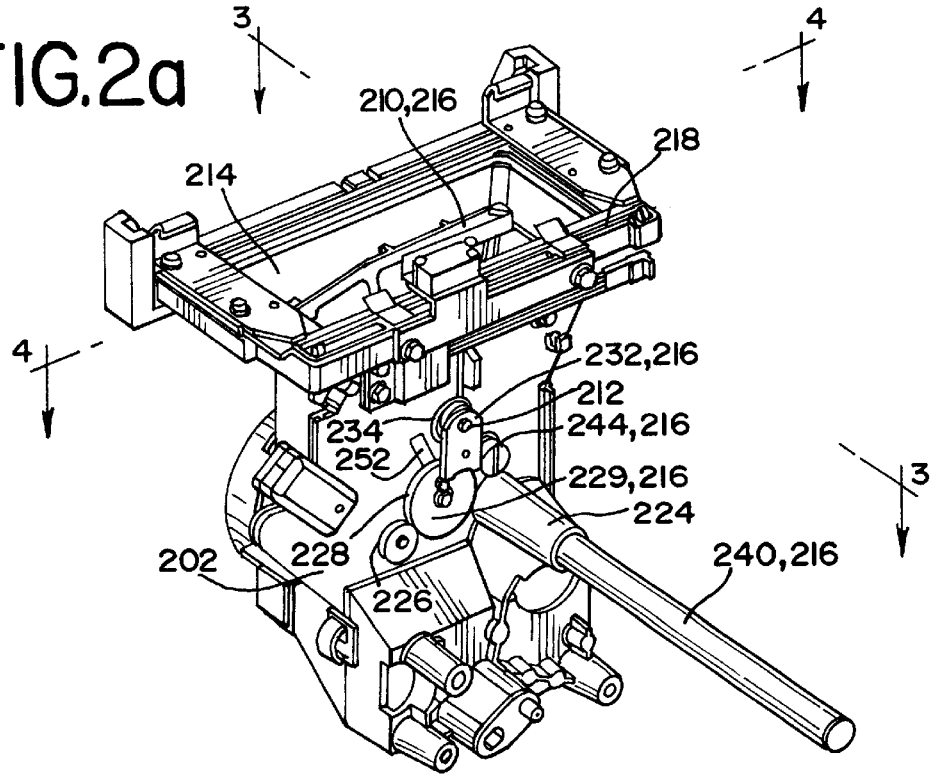
FIG. 2*a* shows a perspective view of a replenisher station having a control device for generating a timing signal with the toner bottle removed, according to one embodiment of the present invention.

FIG. 2 shows a perspective view of a replenisher station 200 for supplying toner 206 to the toning station 125. The replenisher station has a toner bottle 204, which stores a fresh supply of toner 206, a replenisher housing 202, and a moving part 216, according to an embodiment of the present invention. Toner bottle 204 can be any toner bottle which, in connection with replenisher station 200, supplies toner 206 to toning station 125. Typically, toner bottle 204 is made from a plastic material and forms a cavity within which a fresh supply of toner 206 is stored. Toner bottle 206 forms an opening (not shown) at one end which is adapted to mate with an opening 218 of the replenisher housing 202, as illustrated in FIGS. 2 and 2*a*.

Replenisher housing 202 forms a cavity 214 adapted to receive toner 206 from toner bottle 204. In one embodiment, replenisher housing is connected with at least one moving part 216, as illustrated in FIG. 2*a*. Preferably, replenisher housing 202 is constructed from a rigid material, such as, but not limited to: metals such as iron, steel, aluminum, titanium, and brass; plastics such as ethylene-vinyl acetate; acrylics such as acrylonitrile-butadiene-styrene and acrylic-styrene-acrylonitrile; polymers such as polycarbonate, polyurethane, polythylene, polybutylene, polyvinyl chloride, polyphenylene oxide, chlorinated polyvinyl chloride, polyamides, and polybutylene terephthalate; carbon fiber; graphite; and any other rigid material known to those skilled in the art. Replenisher housing 202 may be formed in one of many ways known to those skilled in the art, such as die-casting, machine forming, and blow-molding. Replenisher housing 202 acts as a base for mounting items such as moving part 216 and a replenisher motor 220 and as a transfer mechanism for transferring toner 206 from the toner bottle 204 to the toning station 125.

Moving part 216 is connected with the replenisher station 200, as illustrated in FIGS. 2, 2*a*, 3, and 4. Preferably, moving part 216 is movably connected with the replenisher housing 202. Moving part 216 moves with respect to replenisher housing 202 in one of a number of ways know to those skilled in the art. For example, moving part 216 may move by rotation, translation or a combination of rotation and translation. Moving part 216 includes any part that is designed to move with respect to replenisher housing 202, such as, a fluted roller, a brush, a gear, a roller, an agitator, a lever, a cam, a shaft, a wheel, a spring, an arm, and an auger. Preferably, moving part 216 helps turn and meter the toner 206, and/or guides the toner 206 into the toning station 125.

In one embodiment, moving part 216 is a brush or series of brushes that are connected to replenisher housing 202 and are preferably located within cavity 214. The brush or series of brushes are used to turn and meter the toner 206 as the toner 206 falls down into the cavity 214 from toner bottle 204. In one embodiment, moving part 216 is a fluted roller that is connected to replenisher housing 202 and is preferably located within cavity 214. The fluted roller is used to turn and meter the toner 206 as the toner 206 falls down into the cavity 214 from toner bottle 204. In one embodiment, moving part 216 comprises any one of a replenisher agitator 210, a pin 212, a replenisher motor 220, a drive gear 222, an agitator stop 244, an intermediate gear 226, a cam gear 228, a cam 230, an agitator arm 232, a spring 234, a supply shaft 240, an auger 242, and a shaft gear 224, as illustrated in FIGS. 2, 2*a*, 3, and 4. The flow of toner 206 is indicated by arrows B.

Control device 252 is located near the moving part 216, wherein the control device 252 monitors the movement of the moving part 216 and generates a timing signal in response. Control device 252 is any device known to those skilled in the art which can be used to monitor the movement of an object such as moving part 216. Control device 252 includes such things as motion sensors, hall-effect sensors 266, optical sensors 274, heat sensors, digital or analog cameras, mechanical switches, levers, and gears. If moving part 216 is moving, the control device 252 generates a timing signal in response to the movement. In one embodiment, the control device 252 generates a timing signal that is a waveform, wherein the frequency of the waveform is used to indicate the actual rate at which the moving part 216 moves at. Preferably, the waveform has a frequency which varies proportionally with respect to the rate that moving part 216 is moving at. For example, in one embodiment, if the rate at which moving part 216 is moving at increases, the frequency of the timing signal increases as well. In one embodiment, the control device 252 generates a digital signal, wherein the frequency at which the moving part 216 moves at can be determined and from the frequency, the actual rate at which the moving part 216 moves at can also be determined.

Figure 3:
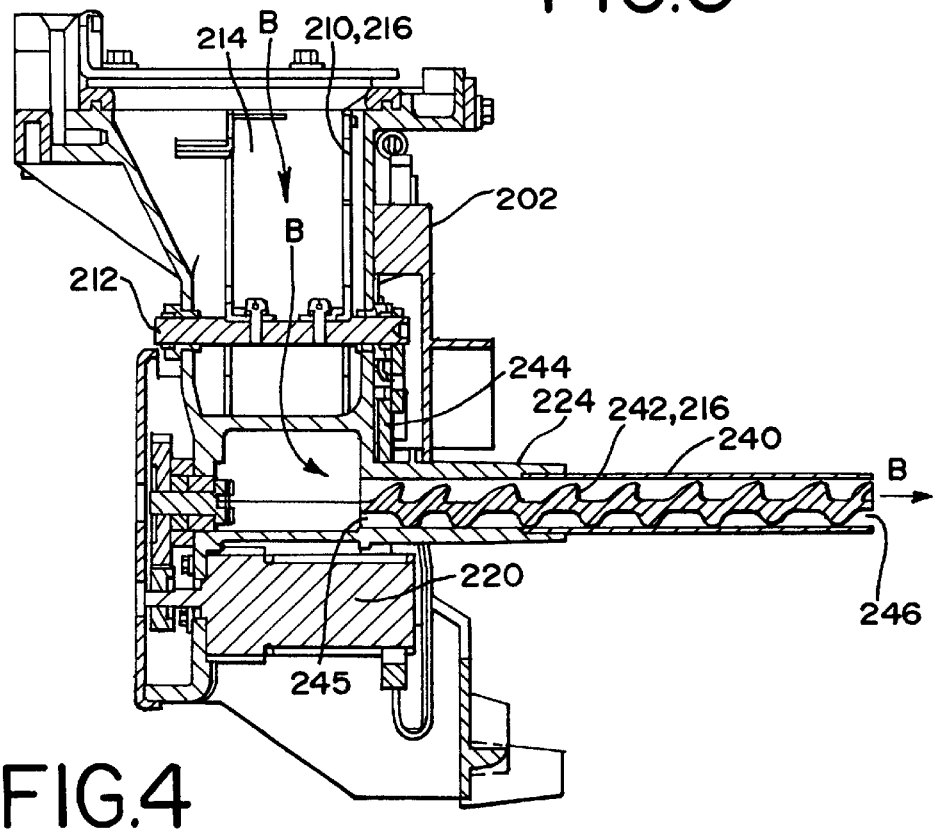
FIG. 3 shows a cross-sectional front view of the replenisher station of FIG. 2*a,* according to one embodiment of the present invention.
Figure 4:
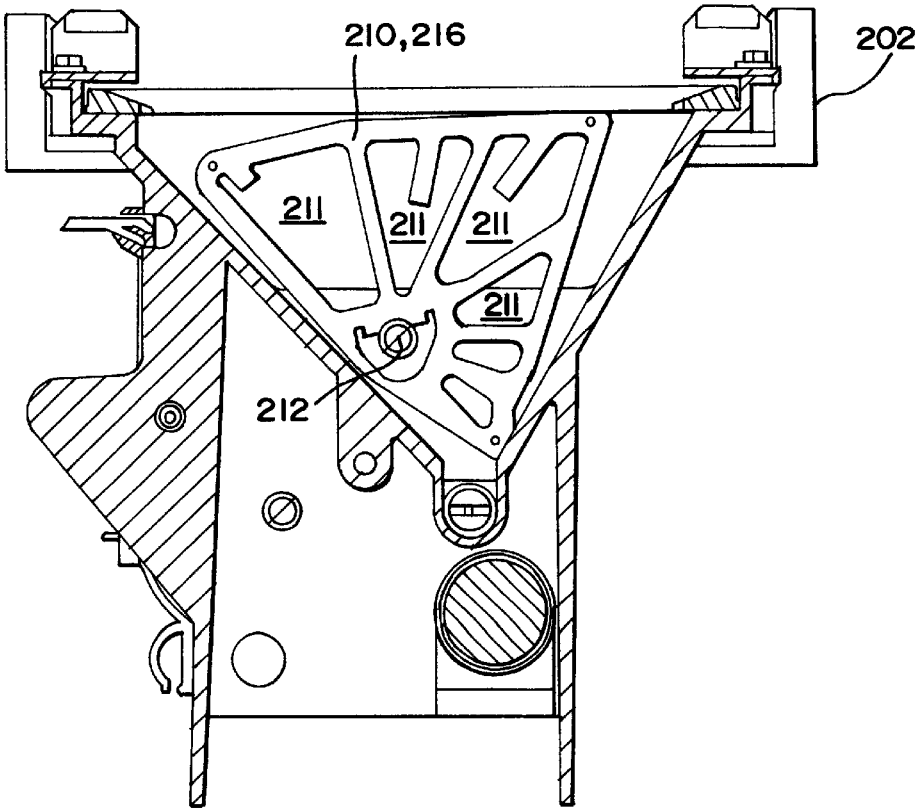
FIG. 4 shows a cross-sectional side view of the replenisher station of FIG. 2*a,* according to one embodiment of the present invention.

In one embodiment, replenisher station 200 further comprises a replenisher agitator 210 located within cavity 214, agitator arm 232, and cam gear 228, as illustrated in FIGS. 2*a*, 3, and 4. Replenisher agitator 210 is movably connected to the replenisher housing 202 and is used to turn and meter the toner 206 as the toner 206 falls down into the cavity 214 from toner bottle 204. Replenisher agitator forms openings 211 which aid in the turning and metering of toner 206. Agitator arm 232 is connected with replenisher agitator 210 through a pin 212. Pin 212 is rotatably mounted with replenisher housing 202, as illustrated in FIGS. 3 and 4, and fixedly mounted with replenisher agitator 210 and agitator arm 232.

Figure 5:
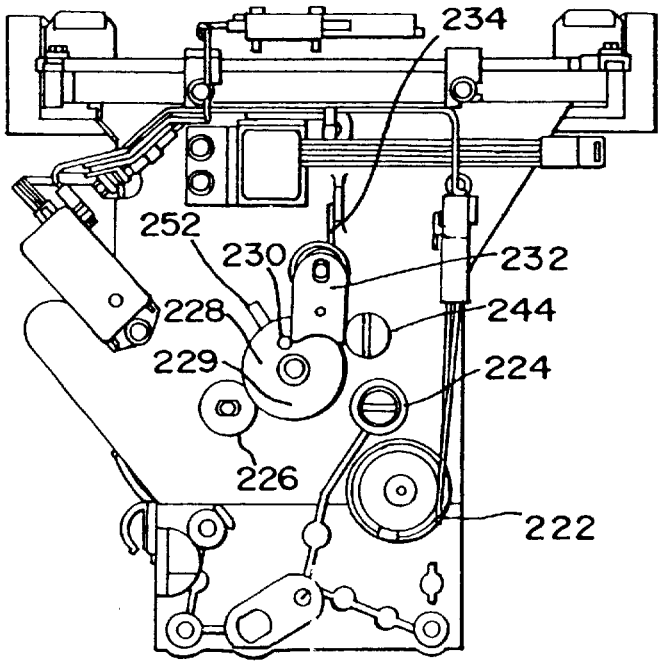
FIG. 5 shows a side view of the replenisher station of FIG. 2*a,* according to one embodiment of the present invention.
Figure 6:
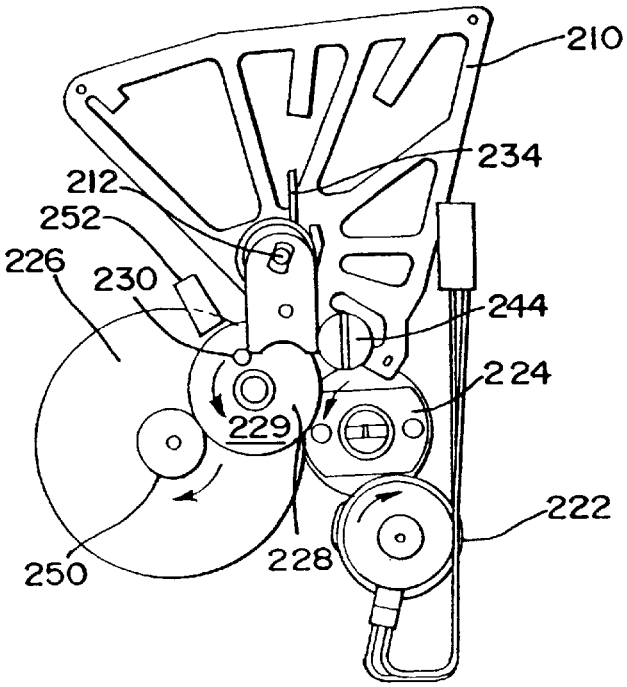
FIG. 6 shows a partial side view of the replenisher station of FIG. 2*a,* according to one embodiment of the present invention.

Cam gear 228 is rotatably mounted with the replenisher housing 202 adjacent the agitator arm 232, as illustrated in FIG. 2*a*. The cam gear 228 has a cam 230 projecting from a surface 229 of the cam gear 228, as illustrated in FIGS. 5 and 6. The cam 230 contacts at least a portion of the agitator arm 232 at least once per revolution of the cam gear 228, causing the agitator arm 232 to move. When agitator arm 232 moves, pin 212 rotates and causes replenisher agitator 210 to rotate and therefore turn and meter toner 206. The cam gear 228 rotates at a set rate during operation of the EP image-forming machine 100. As used herein, the set rate is the pre-programmed or predetermined rate at which a part such as moving part 216 moves at. Moreover, as used herein, the actual rate is the rate at which a part such as moving part 216 actually moves at. For example, cam gear 228 may be pre-programmed or set to rotate at a set rate of 300 rpm when in fact cam gear 228 rotates at an actual rate of 295 rpm. In one embodiment, control device 252 monitors the movement or rotation of cam gear 228 and generates a timing signal in response. Preferably, cam gear 228 is movably connected with a drive gear 222 either directly or through a series of gears, such as, a agitator stop 244 and an intermediate gear 226 and pinion 250, as illustrated in FIG. 6. The drive gear 222 is fixedly connected with the shaft of a motor such as replenisher motor 220. As the shaft of replenisher motor 220 rotates, drive gear 222 rotates, and in turn causes cam gear 228 to rotate.

In one embodiment, replenisher station 200 further comprises a supply shaft 240 and a drive gear 222, as illustrated in FIGS. 2*a*, 3, 5 and 6. The supply shaft 240 has a first opening 245 connected with the cavity 214 of the replenisher housing 202, a second opening 246 connected with the toning station 125, and an auger 242 rotatably mounted within the supply shaft 240, as illustrated in FIG. 3. Auger 242 is used to turn and meter the toner 206 as the toner 206 travels from the cavity 214 of the replenisher housing 202 to the toning station 125. Preferably, the auger 242 is rotatably connected with the drive gear 222, as illustrated in FIGS. 3, 4, and 5, either directly or through a series of gears such as shaft gear 224. Shaft gear 224 surrounds supply shaft 240, and is fixedly connected with auger 242. In one embodiment, supply shaft 240 is fixedly connected with auger 242 and shaft gear 224, and rotatably connected with drive gear 222, so that auger 242 rotates when drive gear 222 rotates.

Figure 7:
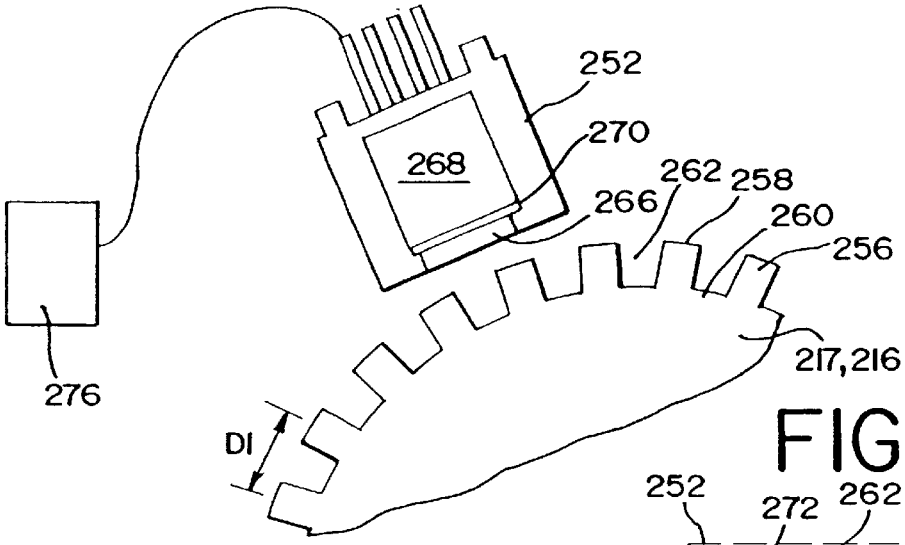
FIG. 7 shows an enlarged partial side view of a control device, a gear, and a clog detection circuit, according to one embodiment of the present invention.

In one embodiment, control device 252 includes a Hall-effect sensor 266, a magnet 268, and a pole piece 270 between the Hall-effect sensor 266 and the magnet 268, as illustrated in FIG. 7. The control device 252 is placed near or adjacent the moving part 216, such as a gear 217, in order to detect the actual rate at which the gear 217 rotates at. Gear 217 includes any gear known to those skilled in the art, such as, a drive gear 222, a shaft gear 224, a agitator stop 244, an intermediate gear 226, or a cam gear 228. In this embodiment, the timing signal is generated in response to differential magnetic signals created by the movement of the moving part 216 and detected by the Hall-effect sensor 266. The Hall-effect sensor 266 includes any Hall-effect sensor known by those skilled in the art, such as the Allegro model ATS610LSA or model ATS6111LSB Dynamic, Peak-Detecting, Differential Hall-Effect Gear-Tooth Sensors, manufactured by Allegro Microsystems, Inc. of 115 North-east Cutoff, Worcester, Mass. 01615-0036.The Hall-effect sensor 266 responds to the differential magnetic signals created by a ferrous target, such as a gear 217 or a moving part 216 manufactured from ferrous materials. In one embodiment, the Hall-effect sensor 266 detects the differential magnetic signals created by peaks 258 of gear teeth 256 and valleys 260 in gaps 262 between gear teeth 256 of a gear 217, as illustrated in FIG. 7, and generates a timing signal as a result. Preferably, the timing signal is a waveform having a frequency that is determined by the distance $D_1$ between the gear teeth 256 and the speed at which the gear 217 rotates at, as illustrated in FIG. 7. Therefore, the frequency of the timing signal can be used to indicate the actual rate at which the gear 217 rotates at.

In one embodiment, control device 252 includes a light source 272 adjacent a moving part 216, and an optical sensor 274, as illustrated in FIGS. 8, 9, 10, and 11. The light source 272 can be any light source known to one skilled in the art, such as a tungsten lamp, a halogen lamp, a laser, or a light emitting diode (LED). Optical sensor 274 is any sensor that can detect the presence of light and create a signal in response. The moving part 216 is placed between the light source 272 and the optical sensor 274. As the moving part 216 moves, a timing signal is generated in response to differential amounts of light created by the movement of the moving part 216 in relation to the light source 272 and the optical sensor 274. As a result, the optical sensor 274 generates a timing signal. In one embodiment, the optical sensor 274 generates a timing signal that is a waveform, wherein the frequency of the waveform is used to indicate the actual rate at which the moving part 216 rotates at. In one embodiment, the optical sensor 274 generates a digital signal, such as a TTL digital signal, wherein the actual rate at which the moving part 216 rotates can be determined from the digital signal.

Figure 9:
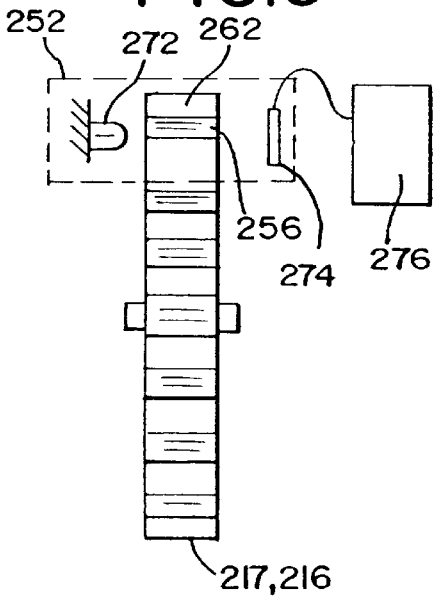
FIG. 9 shows an enlarged partial front view of the light source and the gear of FIG. 8 in relation to a clog detection circuit, according to one embodiment of the present invention.
Figure 8:
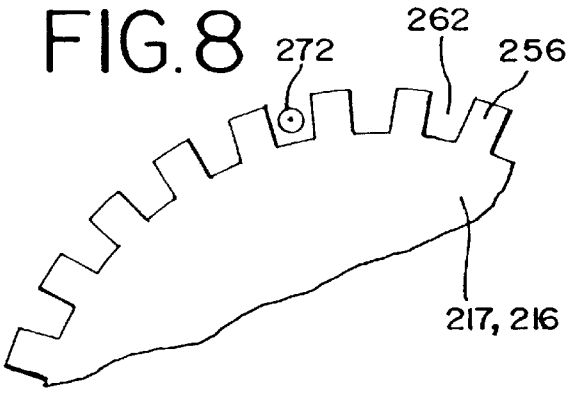
FIG. 8 shows an enlarged partial side view of a light source and a gear, according to one embodiment of the present invention.
Figure 10:
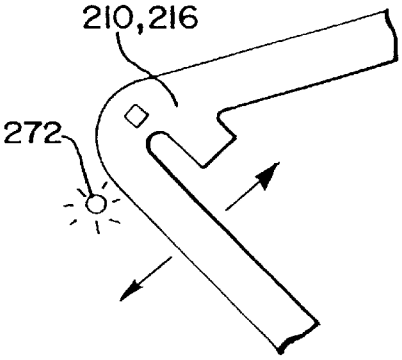
FIG. 10 shows an enlarged partial side view of a light source and a replenisher agitator, according to one embodiment of the present invention.
Figure 11:
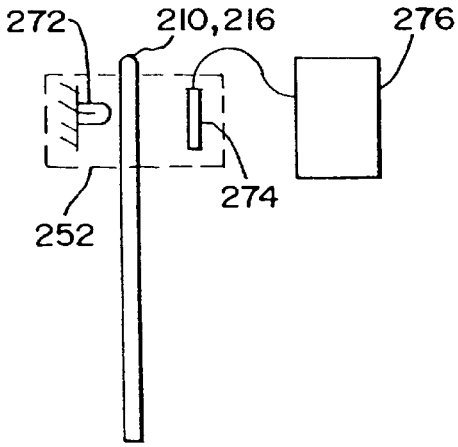
FIG. 11 shows an enlarged partial front view of the light source and the replenisher agitator of FIG. 10 in relation to a clog detection circuit, according to one embodiment of the present invention.

In one embodiment, a gear 217, such as, a drive gear 222, a shaft gear 224, an agitator stop 244, an intermediate gear 226, or a cam gear 228, is placed between the light source 272 and the optical sensor 274, as illustrated in FIGS. 8 and 9. The gear 217 includes gear teeth 256 along the periphery of the gear 217, as illustrated in FIG. 8. The gear teeth 256 block the light source 272 from the optical sensor 274 while the gaps 262 between the gear teeth 256 allow light to hit the optical sensor 274. As a result, the optical sensor 274, upon collecting the light from the light source 272, generates a timing signal. In one embodiment, the gear 217 forms an opening, and as the gear 217 rotates, the opening passes across the light source at least once per revolution of the gear 217. In this embodiment, the gear 217 blocks the light source 272 from the optical sensor 274 while the opening formed by the gear 217 allows light to hit the optical sensor 274. As a result, the optical sensor 274 generates a timing signal. In one embodiment, the replenisher agitator 210 is placed between the light source 272 and the optical sensor 274. The replenisher agitator 210 either blocks the light source 272 from the optical sensor 274 or allows light to hit the optical sensor 274. As a result, the optical sensor 274 generates a timing signal.

In one embodiment, the EP image-forming machine 100 comprises a clog detection circuit 276 connected to the control device 252, wherein the clog detection circuit 276 receives the timing signal and determines if the toner 206 is clogged based upon the value of the timing signal. Preferably, the clog detection circuit 276 comprises a micro-processor or a semiconductor circuit which is programmed to receive the timing signal, determine the frequency or value of the timing signal, compare this value to a stored value, and issue a response based upon the value of the timing signal. In one embodiment, the clog detection circuit 276 calculates an actual rate at which the moving part 216 is moving at based upon the frequency of the timing signal and then determines that the toner 206 is clogged if the actual rate is less than the set rate. In one embodiment, the clog detection circuit 276 signals a user if the actual rate is less than the set rate.

In one embodiment, the EP image-forming machine 100 includes a replenisher motor 220 connected with the moving part 216. The replenisher motor 220 is any out all motor known to those skilled in the art which can cause a shaft to rotate. In one embodiment, the replenisher motor 220 is connected to the replenisher housing 202, as illustrated in FIG. 3. Preferably, the replenisher motor 220 includes a shaft which is fixedly connected with a gear 217, such as, drive gear 222. In one embodiment, drive gear 222 is rotatably connected with, through a series of gears, to the cam gear 228, and/or the shaft gear 224.

Figure 12:
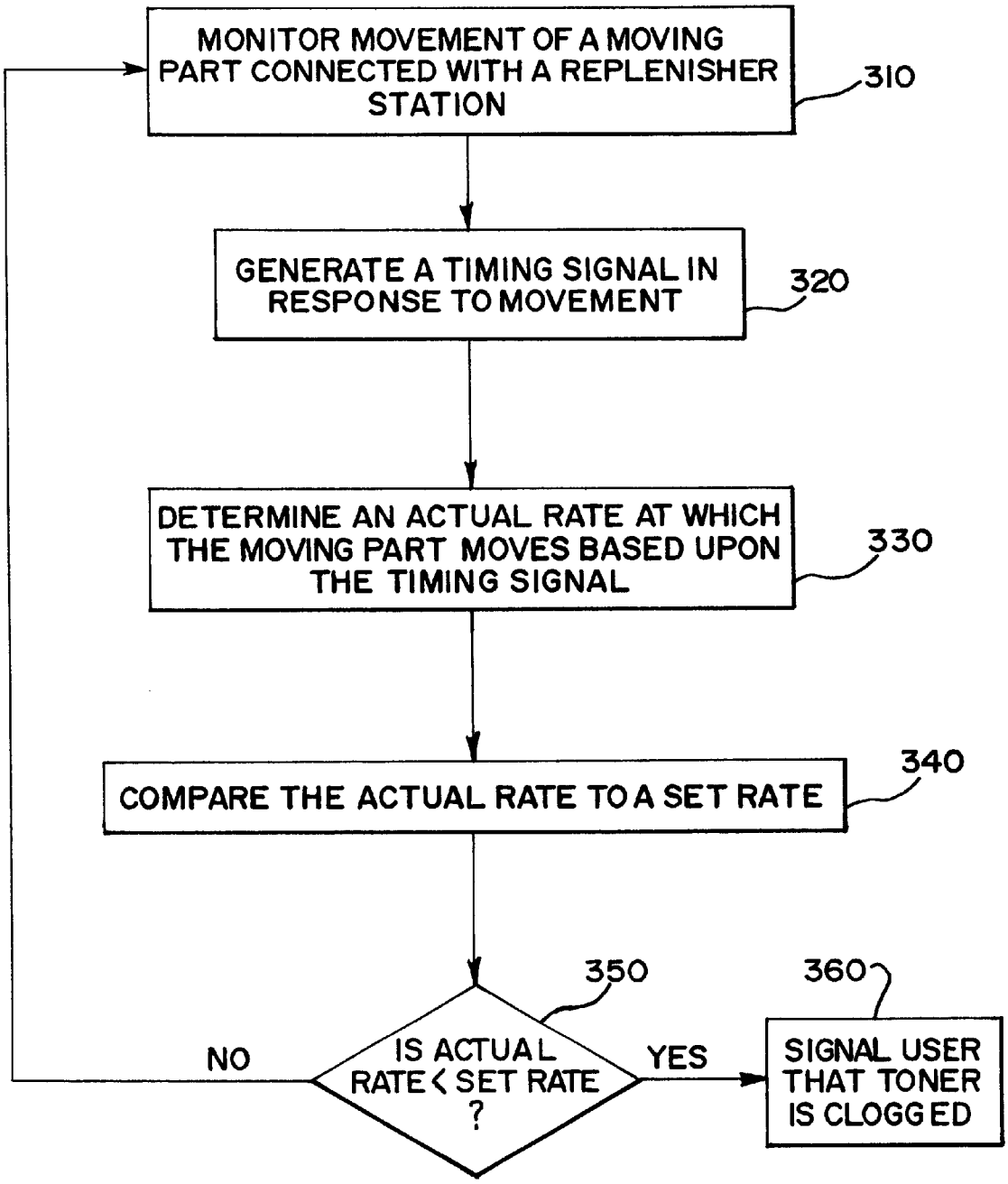
FIG. 12 shows a block diagram of a method for detecting toner clogging in a replenisher station for an image-forming machine, according to one embodiment of the present invention.

FIG. 12 shows a flowchart of a method for detecting toner clogging in a replenisher station 200 for an EP image-forming machine 100 according to one embodiment of the present invention. In step 310, a moving part 216 connected with a replenisher station 200 is monitored for movement. Preferably, the moving part is monitored for movement by a control device 252, as descried above.

In step 320, as the EP image-forming machine 100 is operated, the moving part 216 moves and a timing signal is generated in response to the movement of the moving part 216. Preferably, the control device 252 generates the timing signal. In standby mode or off mode, generally, all movement of any moving part 216 in the EP image-forming machine 100 ceases.

In step 330, a clog detection circuit 276 determines whether the toner 206 is clogged based upon the value of the timing signal. Preferably, the timing signal generates a frequency that corresponds to the actual rate of movement of the moving part 216.

In step 340, the clog detection circuit 276 compares the actual rate of movement of the moving part 216 to a set rate of movement for the moving part 216. In step 350, the clog detection circuit 276 determines whether the toner 206 is clogged based upon whether the actual rate is less than the set rate. If the actual rate is less than the set rate, then the clog detection circuit 276 signals the user that the toner 206 is clogged, in step 360. However, if the actual rate is greater than or equal to the set rate, then the moving part 216 connected with the replenisher station 200 is again monitored for movement, as shown in step 310.

While the invention has been described and illustrated, this description is by way of example only. Additional advantages will occur readily to those skilled in the art, who may make numerous changes without departing from the true spirit and scope of the invention. Therefore, the invention is not limited to the specific details, representative machines, and illustrated examples in this description. Accordingly, the scope of this invention is to be limited only as necessitated by the accompanying claims.

What is claimed is:

1. An image-forming machine comprising:

a photoconductor having a surface;

a toning station adjacent the surface of the photoconductor, the toning station having at least one roller for supplying toner near the surface of the photoconductor;

a replenisher station for supplying toner to the toning station, the replenisher station comprising:

a moving part connected with the replenisher station, and a control device located near the moving part, wherein the control device monitors the movement of the moving part and generates a timing signal in response.

2. An image-forming machine according to claim 1, wherein the replenisher station further comprises:

a replenisher housing forming a cavity adapted to receive toner from a toner bottle;

a replenisher agitator located within the cavity, the replenisher agitator movably connected to the replenisher housing;

an agitator arm connected with the replenisher agitator; and a cam gear rotatably mounted to the replenisher housing adjacent the agitator arm, the cam gear having a cam projecting from a surface of the cam gear, wherein the cam contacts at least a portion of the agitator arm at least once per revolution of the cam gear, wherein the cam gear rotates at a set rate during operation of the image-forming machine.

3. An image-forming machine according to claim 2, wherein the control device monitors the movement of the cam gear and generates a timing signal in response.

4. An image-forming machine according to claim 1 further comprising a supply shaft having a first opening connected with a cavity of the replenisher station, a second opening connected with the toning station, and an auger rotatably mounted within the supply shaft, wherein the auger is rotatably connected with a drive gear.

5. An image-forming machine according to claim 1, wherein the control device comprises:

a Hall-effect sensor;

a magnet; and a pole piece between the Hall-effect sensor and the magnet, wherein the timing signal is generated in response to differential magnetic signals created by a cam gear and detected by the Hall-effect sensor.

6. An image-forming machine according to claim 1, wherein the control device comprises:

a light source adjacent a cam gear; and an optical sensor, wherein the cam gear is between the light source and the optical sensor, and wherein the timing signal is generated in response to differential amounts of light created by the movement of the cam gear in relation to the light source and the optical sensor.

7. An image-forming machine according to claim 1 further comprising a clog detection circuit connected to the control device, wherein the clog detection circuit receives the timing signal and determines if toner is clogged based upon the timing signal.

8. An image-forming machine according to claim 7, wherein the clog detection circuit calculates an actual rate at which the moving part moves at based upon the frequency of the timing signal, and wherein the clog detection circuit determines that toner is clogged if the actual rate is less than a set rate.

9. An image-forming machine according to claim 8, wherein the clog detection circuit signals a user if the actual rate is less than the set rate.

10. An image-forming machine according to claim 1 further comprising a motor connected with the moving part.

11. An image-forming machine comprising:

a replenisher station for supplying toner to a toning station of the image-forming machine, the replenisher station comprising:

a replenisher housing forming a cavity adapted to receive toner from a toner bottle, and a moving part connected with the replenisher housing;

a motor connected with the moving part; and a control device mounted near the moving part, wherein the control device monitors the movement of the moving part and generates a timing signal in response.

12. An image-forming machine according to claim 11, wherein the moving part comprises a supply shaft having a first opening connected with the cavity of the replenisher housing and a second opening opposed to the first opening and an auger mounted within the supply shaft.

13. An image-forming machine according to claim 11 further comprising a clog detection circuit connected to the control device, wherein the clog detection circuit receives the timing signal and determines if toner is clogged based upon the timing signal.

14. An image-forming machine according to claim 13, wherein the moving part moves at a set rate during operation of the image-forming machine, wherein the clog detection circuit calculates an actual rate at which the moving part moves based upon the frequency of the timing signal, and wherein the clog detection circuit determines that toner is clogged if the actual rate is less than the set rate.

15. An image-forming machine according to claim 11, wherein the moving part comprises a drive gear rotatably mounted to the replenisher housing, the drive gear fixedly connected with the motor, wherein the control device monitors the rotation of the drive gear and generates a timing signal in response.

16. An image-forming machine according to claim 11, wherein the moving part comprises a replenisher agitator located within the cavity, the replenisher agitator movably connected with the replenisher housing, wherein the control device monitors the movement of the replenisher agitator and generates a timing signal in response.

17. An image-forming machine according to claim 16, wherein the replenisher station further comprises:

an agitator arm connected with the replenisher agitator; and a cam gear rotatably mounted with the replenisher housing adjacent the agitator arm, the cam gear having a cam projecting from a surface of the cam gear, wherein the cam contacts at least a portion of the agitator arm at least once per revolution of the cam gear.

18. An image-forming machine according to claim 17, wherein the control device monitors the rotation of the cam gear and generates a timing signal in response.

19. A replenisher station for supplying toner to a toning station of an image-forming machine, the replenisher station comprising:

a replenisher housing forming a cavity adapted to receive toner from a toner bottle;

a moving part connected with the replenisher housing; and a control device located near the moving part, wherein the control device monitors the movement of the moving part and generates a timing signal in response.

20. A replenisher station according to claim 19, wherein the moving part comprises a replenisher agitator.

21. A replenisher station according to claim 20 further comprising an agitator arm connected with the replenisher agitator;

a cam gear rotatably mounted to the replenisher housing adjacent the agitator arm, the cam gear having a cam projecting from a surface of the cam gear, wherein the cam contacts at least a portion of the agitator arm at least once per revolution of the cam gear, wherein the cam gear rotates at a set rate during operation of the image-forming machine, and wherein the control device monitors the rotation of the cam gear and generates a timing signal in response.

22. A replenisher station according to claim 19, wherein the moving part comprises an auger.

23. A replenisher station according to claim 19 further comprising a clog detection circuit connected to the control device, wherein the clog detection circuit receives the timing signal and determines if toner is clogged based upon the timing signal.

24. A method for detecting toner clogging in a replenisher station for an image-forming machine comprising:

monitoring the movement of a moving part connected with the replenisher station;

generating a timing signal in response to the movement of the moving part; and determining whether toner is clogged in the replenisher station based upon the timing signal.

25. A method for detecting toner clogging according to claim 24, wherein the moving part comprises a replenisher agitator located within a cavity of the replenisher station.

26. A method for detecting toner clogging according to claim 25 wherein the moving part comprises a gear connected with the replenisher agitator.

27. A method for detecting toner clogging according to claim 24, wherein the moving part comprises an auger located within a supply shaft connected with the replenisher station.

28. A method for detecting toner clogging according to claim 24, wherein the determining of whether toner is clogged further comprises:

determining an actual rate at which the moving part moves based upon the frequency of the timing signal; and comparing the actual rate to a set rate.

29. A method for detecting toner clogging according to claim 28 further comprising signaling that toner is clogged if the actual rate is less than the set rate.

30. A method for detecting toner clogging according to claim 24, further comprising placing a control device near the moving part, wherein the monitoring of the movement of the moving part further comprises using the control device.

* * * * *